US005445497A

United States Patent [19]

Seemar

[11] Patent Number: 5,445,497

[45] Date of Patent: Aug. 29, 1995

[54] VARIABLE PITCH PROPELLERS

[76] Inventor: George H. Seemar, 3563 Aquetong Rd., Carversville, Pa. 18913-9700

[21] Appl. No.: 173,072

[22] Filed: Dec. 27, 1993

[51] Int. Cl.[6] ..... B63H 3/00

[52] U.S. Cl. ..... 416/131; 416/207

[58] Field of Search ..... 416/131, 205, 207, 219 A, 416/220 A

[56] References Cited

U.S. PATENT DOCUMENTS

| | | | |
|---|---|---|---|
| 1,189,749 | 7/1916 | Stodder | 416/131 |
| 1,831,692 | 11/1931 | Triplett | 416/131 |
| 2,491,862 | 12/1949 | Klos | 416/131 |
| 3,255,827 | 6/1966 | Nichols | 416/207 |
| 3,557,744 | 1/1971 | Herbert | 416/207 |
| 3,711,220 | 1/1973 | Ramback et al. | 416/207 |
| 4,692,097 | 9/1987 | Bibollet | 416/205 |

FOREIGN PATENT DOCUMENTS

| | | | |
|---|---|---|---|
| 1426840 | 3/1969 | Germany | 416/207 |

*Primary Examiner*—Edward K. Look
*Assistant Examiner*—James A. Larson
*Attorney, Agent, or Firm*—Z. T. Wobensmith, III

[57] ABSTRACT

A variable pitch propeller primarily for marine use which includes a hub for mounting on a driven shaft. The hub has a plurality of blades which are mounted to bearing rings which are carried in recesses in the hub, with removable snap rings retaining the bearings therein with cap screws from the bosses extending to and engaged with the bearing rings for full 360° rotation to automatic pitch positions and with cap screws which may extend into spaced holes in the hub for setting the blades to desired fixed positions.

2 Claims, 3 Drawing Sheets

VARIABLE PITCH PROPELLERS

BACKGROUND OF THE INVENTION

This invention relates to propellers for marine use for which the pitch of the blades is capable of being automatically varied for a full 360° rotation by rotation of the output shaft or which can be fixed at different pitch positions.

DESCRIPTION OF THE PRIOR ART

"Fixed Pitch Propellers" as manufactured and sold today are pretty much the same as they have been for many years. They are good products and are purchased by boat owners because there haven't been any other satisfactory choices offered. However, their function is limited to whatever "pitch" or "camber" is built into the particular propeller. The propeller is called a "fixed pitch propeller" because it has a "fixed pitch" which in essence means that it can only perform "optimally" at one selected design condition. Therefore, if a fixed pitch propeller is designed with a specific pitch or camber and if it is designed with a "pitch" which will absorb the "rated engine power" when the boat is running free at light load, then the engine will not be able to reach its rated speed and power when there is a substantial increase in the load. If the propeller pitch is designed for use at high loads then it will not operate satisfactorily at light loads. It is well established that a propeller works most efficiently at a certain "slip" which depends upon the actual working conditions.

Operating savings with respect to fuel, lube oil, compressed air engine maintenance and repairs are important. It is well established that engine starts and stalls are costly because of their accumulative effects on an engine. "Variable Pitch Propellers" would enable engine starts to be greatly reduced, and engine stalls to be eliminated, thereby reducing piston ring and cylinder wear. The boat would also be capable of being run indefinitely at very slow speed without stalling or fouling. Variable Pitch propellers avoid the risk that engine performance may be penalized by not selecting the best pitch when the propeller is designed, because the pitch can be varied to obtain top engine performance under any and all operating conditions.

A point of considerable practical importance is that a variable pitch propeller system facillitates the standardization of coordinated propulsion systems. A few standardized variable pitch propellers can replace some hundreds of varieties of fixed-pitch propellers. Most boat owners often overload their boats with extra people or gear, and there is no easy way that the boat owner can compensate for this condition, since he cannot change the pitch of the propeller because it is a "fixed pitch" propeller. In order for the boat owner to be able to compensate for "overloading" there must be a means to change the pitch of the propeller in order to use 100% of the rated power, otherwise it will operated at approximately 70% power. The answer to this dilemma is to install a propeller whose pitch can be changed manually, automatically, or by hand directly on the propeller.

Remote manual control propellers have cams and other mechanism to vary the pitch of the blades which mechanism is carried in the propeller and connected to the bridge by cables which are manipulated to vary the pitch. This type of mechanism is complicated, expensive and can easily become frozen due to the corrosive action of the salt water to which it is often subjected.

There have been attempts to develop an automatic variable pitch propeller such as shown in U.S. Pat. No. 4,304,524 to Coxon, which has a plurality of variable position blades, each of which has its pivot axis offset rearwardly from the center of rotation of the boss which mounts it to the hub. The Coxon apparatus can not be set at a fixed pitch position, is complicated, delicate, subject to corrosion and jamming, and requires blades of special shape which restrict its use. Other patents which illustrate attempts to solve the problem are U.S. Pat. Nos. 4,801,243 to Norton; 4,047,841 to Laurin; 4,058,360 to Hirschberger; 4,693,671 to Thornton, Jr., et al.; and 4,792,279 to Bergeron. None of these patents, however, discloses structure which does not suffer from the shortcomings of the prior art structures, is simple to construct, does not jam, and provides a propeller which can provide a full 360° automatic blade pitch or variable fixed pitch.

SUMMARY OF THE INVENTION

The disadvantages of the prior art are overcome and the invention provides a propeller which has blades whose pitch position can be automatically varied over 360° and also can be fixed at a location which is optimum for various boat and engine combinations. The blades can also be assembled so that they are freely rotatable for a full 360° about their bosses, and upon rotation of the shaft on which they are mounted assume positions dependent upon the RPM of the shaft to provide a controlled slip and improved propulsion efficiency.

The principal object of the invention is to provide a variable pitch propeller with selective fixed or automatically adjustable blade pitch for a full 360° rotation.

A further object of the invention is to provide a propeller which is useful with a wide variety of boat and engine combinations.

A further object of the invention is to provide a propeller which increases overall boat performance equivalent to an increase in power up to 25%, and increases the performance and reduces operating wear and expense under a variety of loading and operating conditions.

A further object of the invention is to provide a propeller whose mechanism is far simpler, weighs less, costs less, and is easier to maintain and repair than prior art mechanisms.

A further object of the invention is to provide a propeller whose blades are of cast brass or bronze, are rugged and inexpensive, and in event of damage any blade can be individually readily removed, repaired or replaced in less time and at less cost than prior art fixed pitch or auto pitch propellers.

A further object of the invention is to provide a propeller which elimiates the necessity for running tests to determine the best propeller and pitch design for a new or existing boat, saving time and money in developing new designs, models and power combinations.

Other objects and advantageous features of the invention will be apparent from the description and claims.

DESCRIPTION OF THE DRAWINGS

The nature and characteristic features of the invention will be more readily understood from the following description taken into connection with the accompanying drawings, in which.

Figure 1:
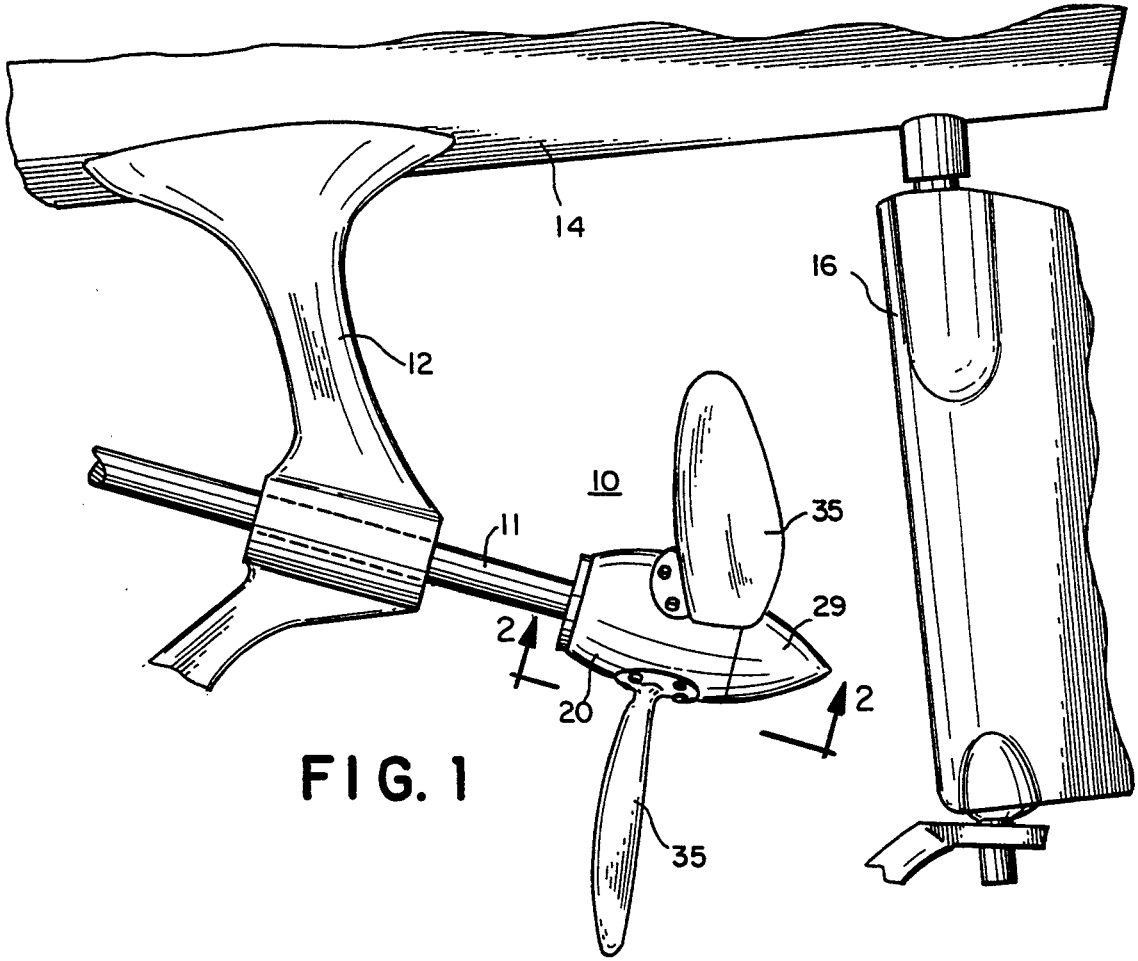
FIG. 1 is a fragmentary, side elevational view of the propeller of the invention.
Figure 2:
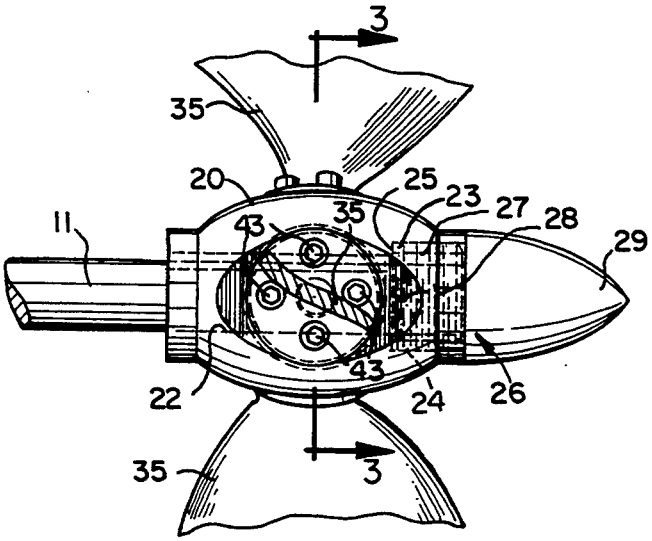
FIG. 2 is a horizontal sectional view, enlarged, taken approximately on the line 2—2 of FIG. 1.
Figure 3:
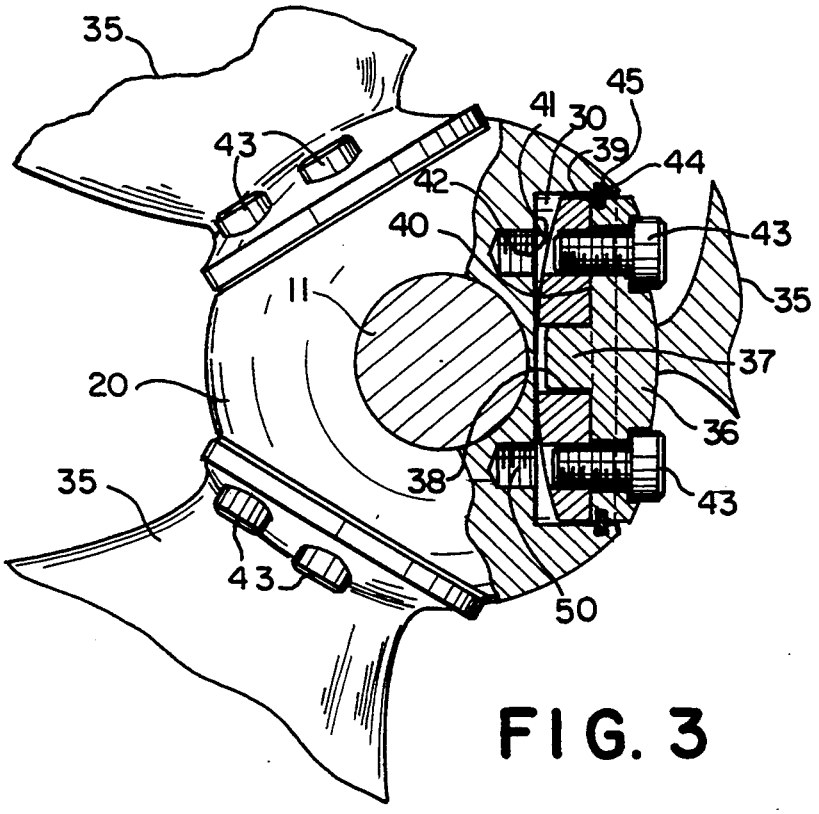
FIG. 3 is a vertical sectional view,, enlarged taken approximately on the line 3—3 of FIG. 2.

It should of course be understood that the description and drawings herein are merely illustrative and that various modifications and changes can be made in the structure disclosed, without departing from the spirit of the invention.

Like numerals refer to like parts throughout the several views.

DESCRIPTION OF THE PREFERRED EMBODIMENTS

Referring now more particularly to the drawings and FIGS. 1 through 4 thereof the variable pitch propeller 10 of the invention is therein illustrated and is mounted to a shaft 11. The shaft 11 is journaled in a bracket 12, which is carried on the bottom 14 of a boat (not shown), which also has a rudder 16 mounted thereto in conventional manner. The propeller 10 includes a generally cylindrical hub 20, which is mounted to the drive shaft 11, with the shaft extending through a tapered passageway 22 in the hub 20. A nut 23 is engaged with threads 24 on the shaft 11 and with a shoulder 25 in a recess 26 in hub 20 thereby retaining the hub thereon. The recess 26 is provided with internal threads 27 with which threads 28 of a tapered cone 29 are engaged, which cone closes off the recess 26 from water infiltration, and which can be readily removed for access to remove nut 23 and hub 20 from shaft 11.

The hub 20 has cylindrical recesses 30, three being illustrated and spaced around the outside of hub 20. The propeller 10 has three blades 35 which are of identical configuration, and each includes a boss 36 which is intended to be received in a recess 30. The boss 36 has a cylindrical projection 37 which is engaged in a hole 38 in a bearing 39. The bearing 39 is of circular configuration with a flat top 40, and an elliptically shaped bottom 41 which is intended to contact bearing surface 42 of recess 30. The bearing 39 is retained to the boss 36 by a plurality of cap screws 43, four being illustrated. The recess 30 has a groove 44 which has a snap ring 45 therein, which bears against the perimeter of the top 40 of the bearing ring 39 to retain it in recess 30, but permits free 360° rotation of the bearing ring 39. The hub 20, bearings 39 and blades 35 are constructed of any suitable material with manganese bronze being particularly suitable for marine propellers.

Figure 4:
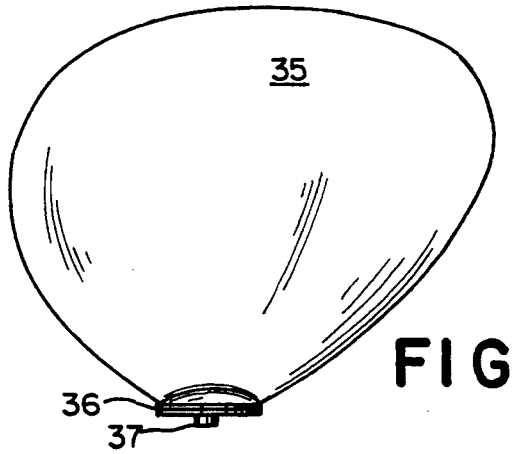
FIG. 4 is a side elevational view of an individual blade used with the propeller of the invention.

The blades 35 one of which is more particularly illustrated in FIG. 4 are shown as being of hyperconic helicoidal configuration but can be of other configurations if desired. The axis of rotation of each of the blades 35 is intended to be at the center of the boss 36, with the blade having a skewed portion such that its shape and the water resistance upon rotation of the hub 20 causes the blade to rotate in recess 30 to a position where it adopts a pitch which is substantially the same as the pitch of the helicoid.

Since the shaft 21 rotates at various RPM the blades 35 will freely rotate to positions which vary for different RPM, which are optimum for the particular RPM, and with a full 360° rotation will also rotate to the appropriate positions for reverse operation.

The blades 35 can also be fixed at selected pitch positions in recess 30 by using a boss (not shown) which reduces boss 36, is thicker than boss 36, and can be secured directly to surface 42 by longer cap screws (not shown) which are engaged in holes 50 in the hub 20 at desired positions depending on the engine, and other operating characteristics.

Figure 5:
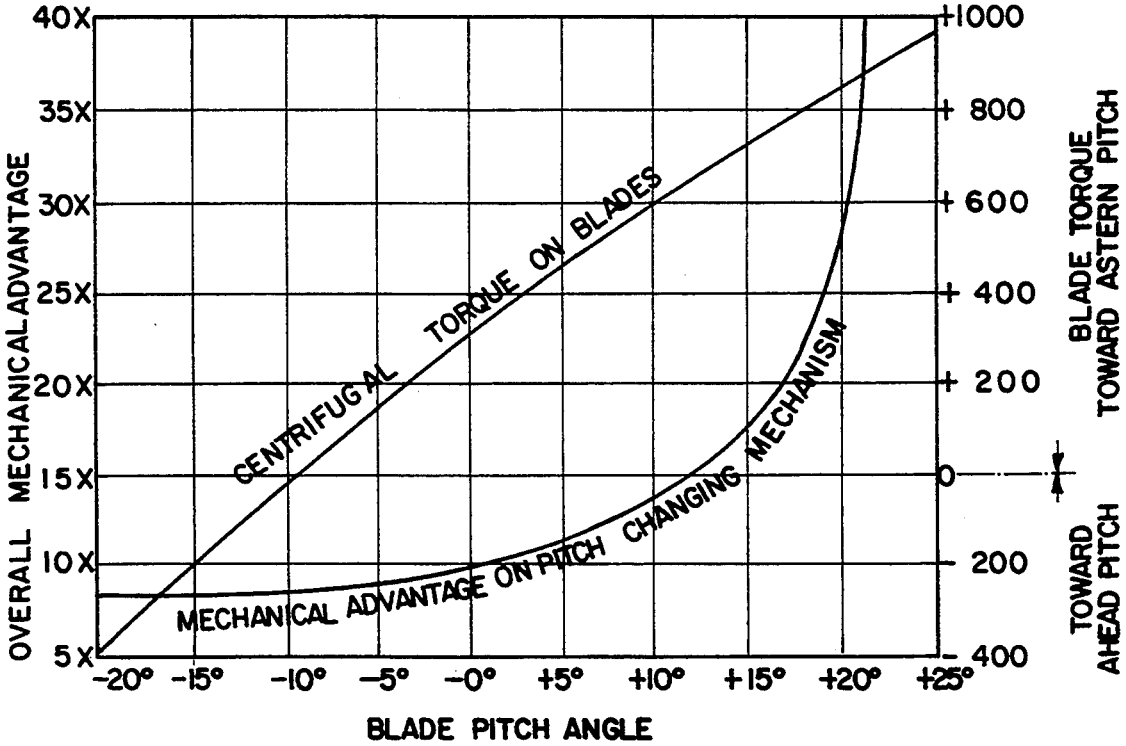
FIG. 5 is a graph of performance characteristics of a propeller of the invention.

Referring now more particularly to FIG. 5, performance characteristics are illustrated in a chart for blade pitch angle versus blade torque for a typical blade.

Figure 6:
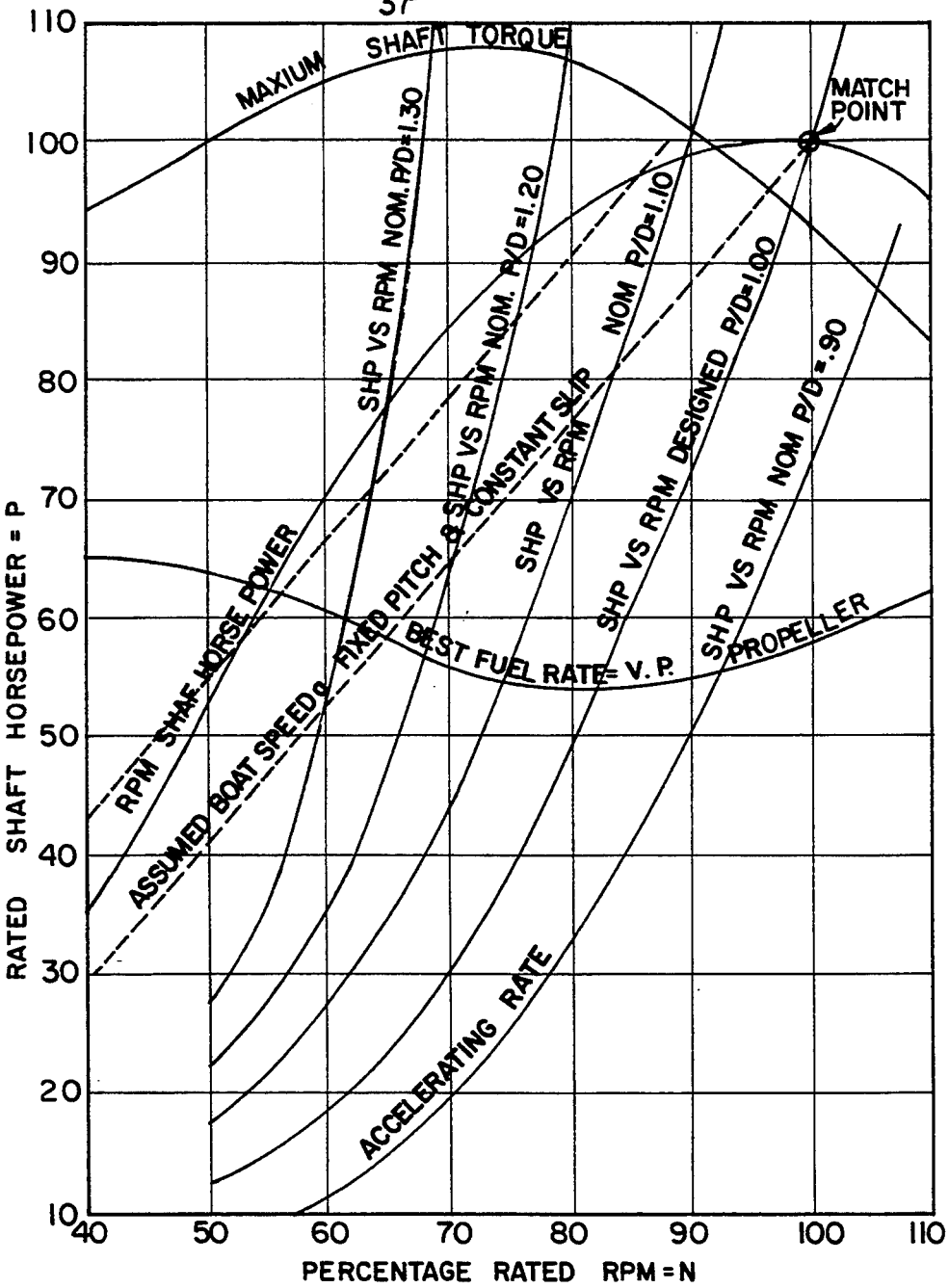
FIG. 6 is a graph which compares the performance characteristics of a conventional fixed pitch propeller with the auto pitch propeller of the invention.

Referring now to FIG. 6 the advantages of the use of fixed versus automatic pitch propellers is illustrated in graph form. Tests were run on a boat which was alternately fitted with a "fixed pitch" propeller and with an automatic variable pitch propeller.

Rated shaft horsepower was plotted versus the percentage rated RPM, which illustrated the advantages and particuarly the added power obtained with the automatic pitch propeller.

It will thus be seen that apparatus has been provided with which the objects of the invention are attained.

I claim:

1. An automatically variable pitch propeller for boats which comprises a hub for mounting to a rotatable variable speed output shaft at least two blades of helicoidal shape spaced recesses in said hub for mounting said blades, said recesses having bearing surfaces, mounting means for mounting said blades in said recesses, said mounting means including bearings for engagement and free rotation in said recesses said blades having bosses thereon which are detachably secured to said bearings and, removable retaining means to retain said bearing in said recess but which permit free rotation of said blades as determined by the speed of said output shaft.

2. A propeller as defined in claim 1 in which said bearings are rings with flat top and elliptically shaped bottom surfaces.

* * * * *

UNITED STATES PATENT AND TRADEMARK OFFICE

CERTIFICATE OF CORRECTION

PATENT NO. : 5,445,497

DATED : August 29, 1995

INVENTOR(S) : George H. Seemar

It is certified that error appears in the above-identified patent and that said Letters Patent is hereby corrected as shown below:

Column 4

Line 18, "reduces" should be "replaces".

Signed and Sealed this

Thirty-first Day of October 1995

*Attest:*

*Attesting Officer*

BRUCE LEHMAN

*Commissioner of Patents and Trademarks*